US005088129A

United States Patent [19]

Kamata

[11] Patent Number: 5,088,129

[45] Date of Patent: Feb. 18, 1992

[54] HELMET

[75] Inventor: Eitaro Kamata, Tokyo, Japan

[73] Assignee: Shoei Kako Kabushiki Kaisha, Tokyo, Japan

[21] Appl. No.: 628,047

[22] Filed: Dec. 17, 1990

[30] Foreign Application Priority Data

Aug. 20, 1990 [JP] Japan ..... 2-86857[U]

[51] Int. Cl.[5] ..... A42B 3/00

[52] U.S. Cl. ..... 2/411; 2/424

[58] Field of Search ..... 2/410, 411, 412, 413, 2/414, 424

[56] References Cited

U.S. PATENT DOCUMENTS 4,821,344 4/1989 Kamata ..... 2/414
4,829,599 5/1989 Giorgio et al. ..... 2/5

FOREIGN PATENT DOCUMENTS 346608 12/1989 European Pat. Off. ..... 2/411
2566632 1/1986 France ..... 2/411
62-70130 5/1987 Japan .
2202729 10/1988 United Kingdom ..... 2/411

*Primary Examiner*—Werner H. Schroeder
*Assistant Examiner*—Michael A. Neas
*Attorney, Agent, or Firm*—Armstrong, Nikaido, Marmelstein, Kubovcik & Murray

[57] ABSTRACT

A helmet includes a cap body which is formed of a shell with a buffer liner fitted herein. The cap body further includes a supporting plate secured thereto for covering a lower end face of a front portion of the buffer liner, and a mounting plate fixedly secured to the cover of an inner pad so as to oppose the supporting plate. The supporting plate and the mounting plate are provided 1) with a guide device for guiding a longitudinal sliding movement of the mounting plate between an engaging position and a separating position for defining a predetermined mounting position of the mounting plate with respect to the supporting plate, and 2) with a first locking device for separating and engaging both the mounting plate and the supporting plate in response to the separating position and engaging position of the mounting plate. A rear end of the inner pad is detachably connected to a rear end of the cap body through a second locking device. The inner pad can reliably and easily be mounted to the cap body at a predetermined postion.

7 Claims, 9 Drawing Sheets

HELMET

BACKGROUND OF THE INVENTION

1. Field of the Invention

The present invention relates to a helmet comprising a cap body which is formed of a shell with a buffer liner fitted therein and which includes an inner pad covered with a cloth cover, disposed inside an inner surface of the buffer liner.

2. Description of the Prior Art

There is conventionally known a helmet, for example, as disclosed in Japanese Utility Model Laid-Open No. 62-70130.

Since an inner pad is brought into direct contact with a head of a wearer of a helmet, the inner pad is likely to get dirty. It is therefore preferable that the inner pad can be detachably mounted in a cap body for cleaning. In the conventional helmet, a cover extension for covering a lower end face of a buffer liner is provided on a cloth cover for covering the inner pad, an insertion piece is secured to a peripheral edge of the cover extension, and the insertion piece is removably inserted between a shell and the buffer liner. However, a gap between the shell and the buffer liner is narrow, and the inserting operation of the insertion piece into the gap, i.e., the mounting operation of the inner pad to a cap body is not easy. Further, since the insertion position of the insertion piece to the gap is not determined, it is difficult to accurately determine the mounting position of the inner pad in the cap body.

SUMMARY OF THE INVENTION

The present invention has been accomplished with such circumstances in view. It is an object of the present invention to provide a helmet of the type described above, in which a mounting position of an inner pad in a cap body is accurately determined to facilitate attachment or detachment of the inner pad in the cap body.

According to the present invention, the cap body further comprises a supporting plate fixed to the cap body for covering a lower end face of a front portion of the buffer liner and a mounting plate fixedly secured to the cover so as to oppose the supporting plate. The supporting plate and the mounting plate are provided 1) with a guide device for guiding a longitudinal sliding movement of the mounting plate between an engaging position and a separating position in order to define a predetermined mounting position of the mounting plate with respect to the supporting plate, and 2) with first locking device for separating and engaging both the mounting plate and the supporting plate in response to the separating position and engaging position of the mounting plate. A rear end of the inner pad is detachably connected to a rear end of the cap body through a second locking device.

With such a construction, the mounting plate is longitudinally slid with respect to the supporting plate under the guidance of the guide device, the mounting plate, i.e., the front portion of the inner pad can be mounted on or removed from the cap body. When mounting the inner pad to the cap body by means of the first locking device, the front portion of the inner pad can be positioned to the cap body, and thus, the rear end of the inner pad is engaged with the rear end of the cap body to reliably mount the inner pad at a predetermined position in the cap body.

These and other objects and features of the present invention will become apparent from the following detailed description in conjunction with the attached drawings.

BRIEF DESCRIPTION OF THE DRAWINGS

Figures illustrate one embodiment of the present invention, wherein.

DESCRIPTION OF THE PREFERRED EMBODIMENT

Figure 1:
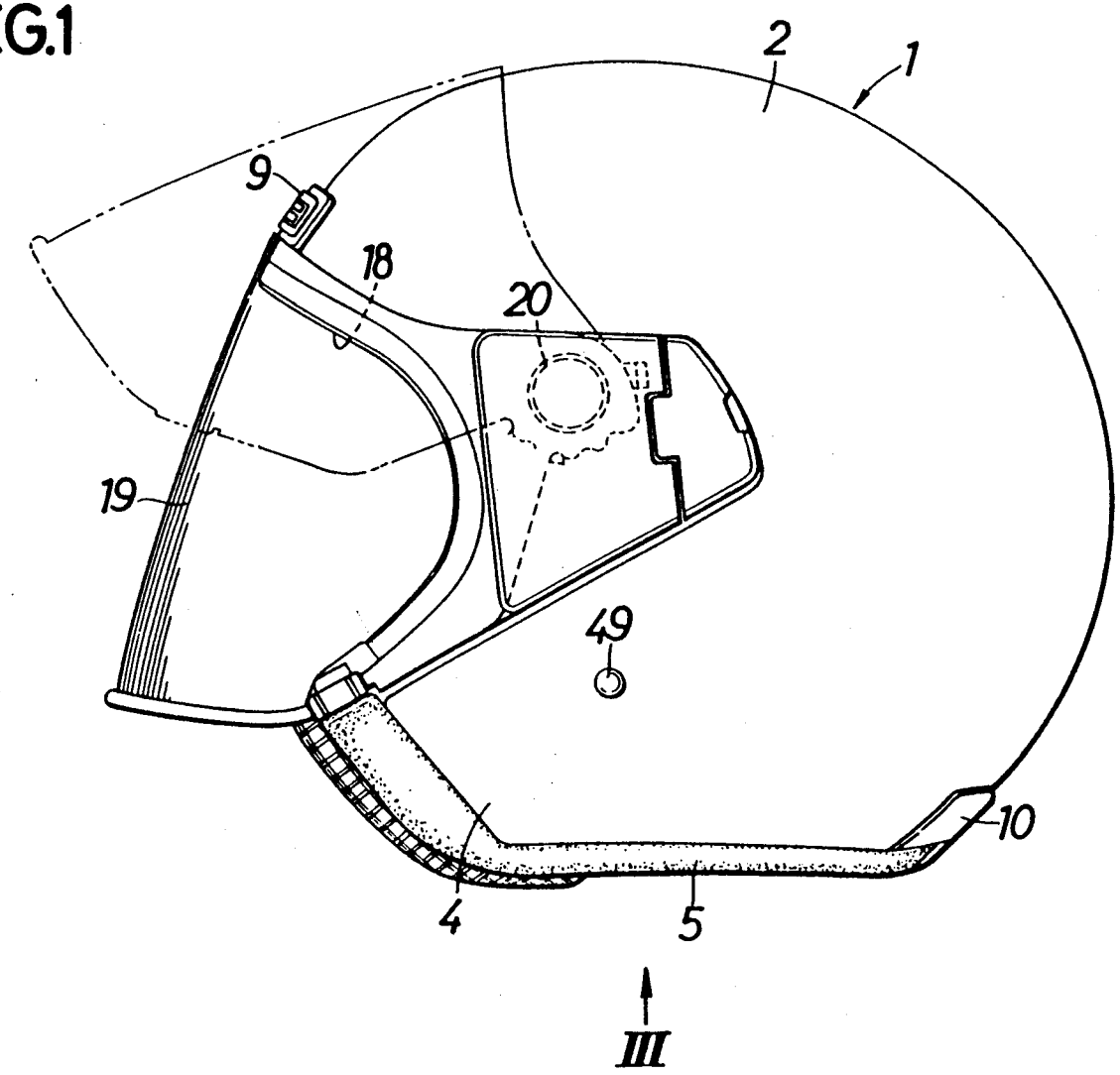
FIG. 1 is a side view of a helmet according to the present invention.
Figure 2:
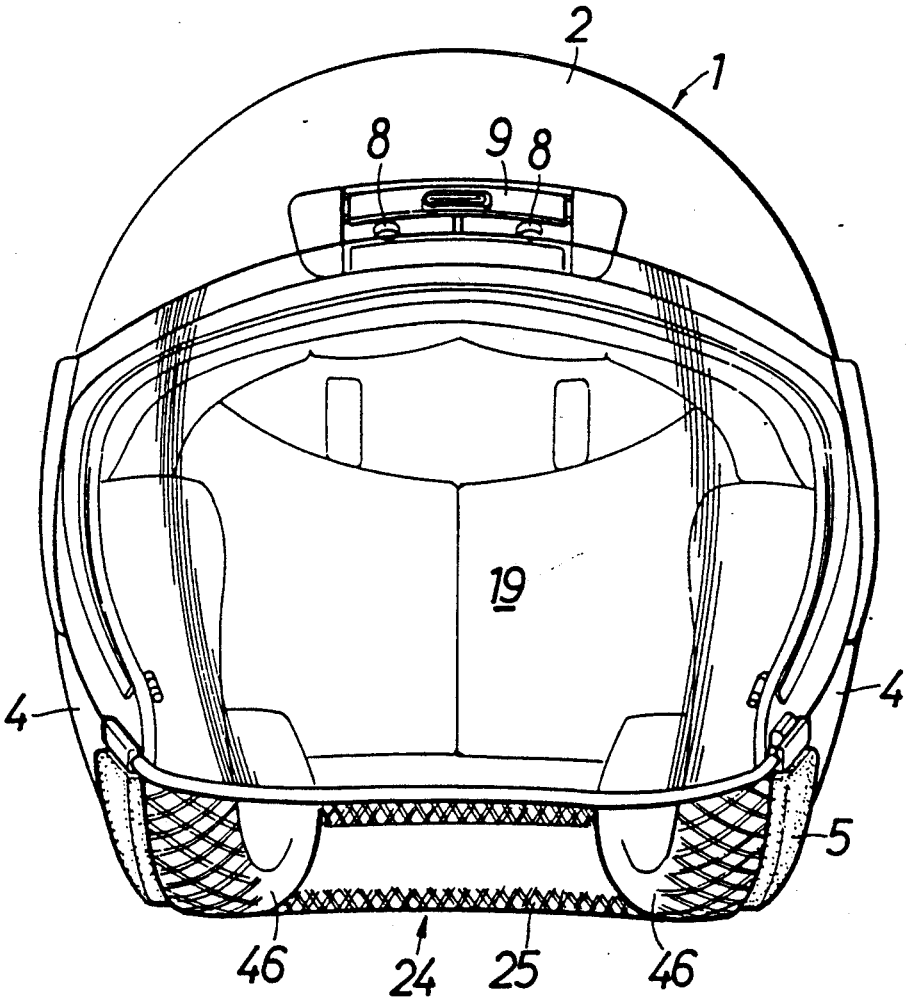
FIG. 2 is a front view of the helmet.
Figure 3:
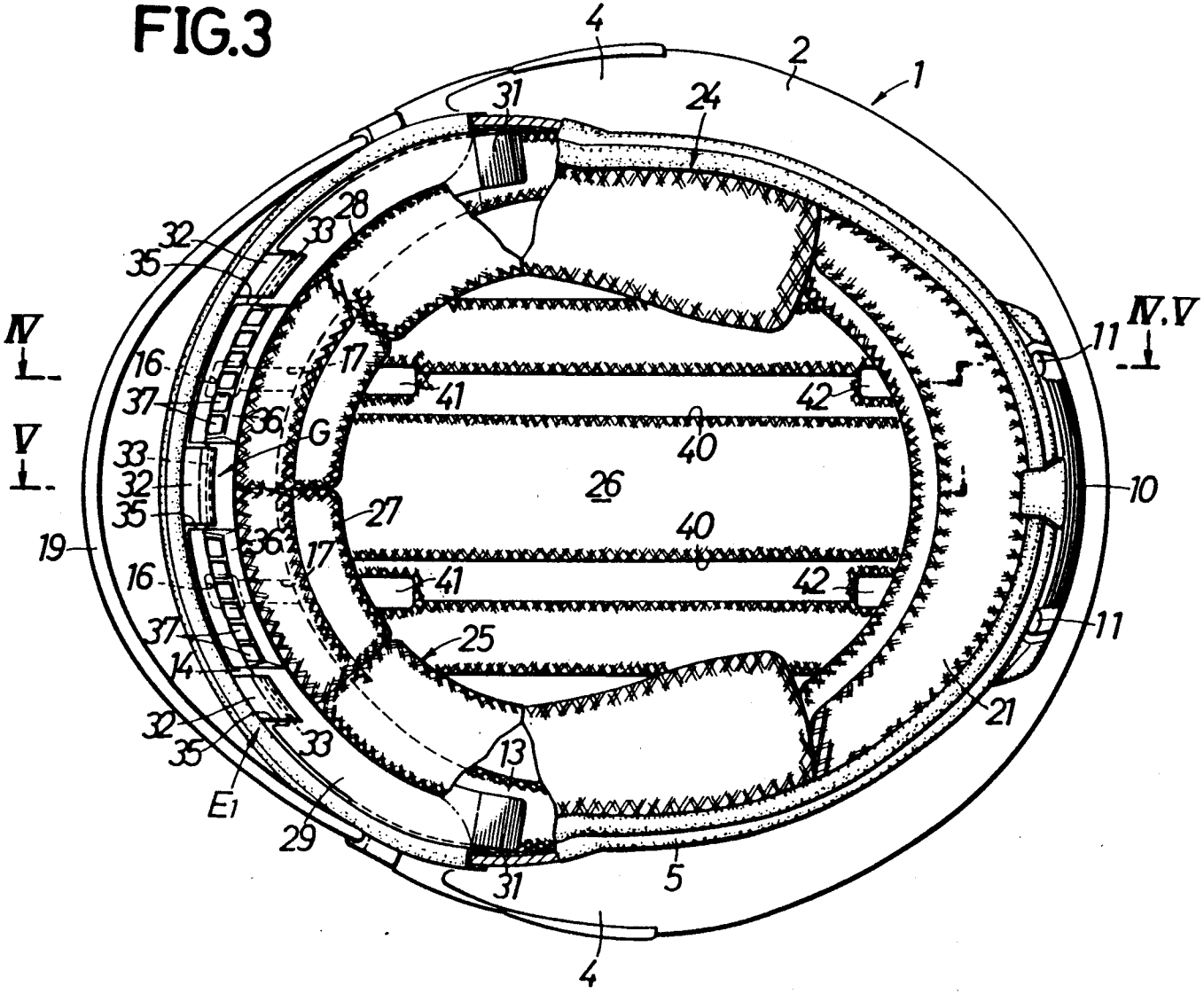
FIG. 3 is an enlarged bottom view as seen from an arrow III in FIG. 1.
Figure 4:
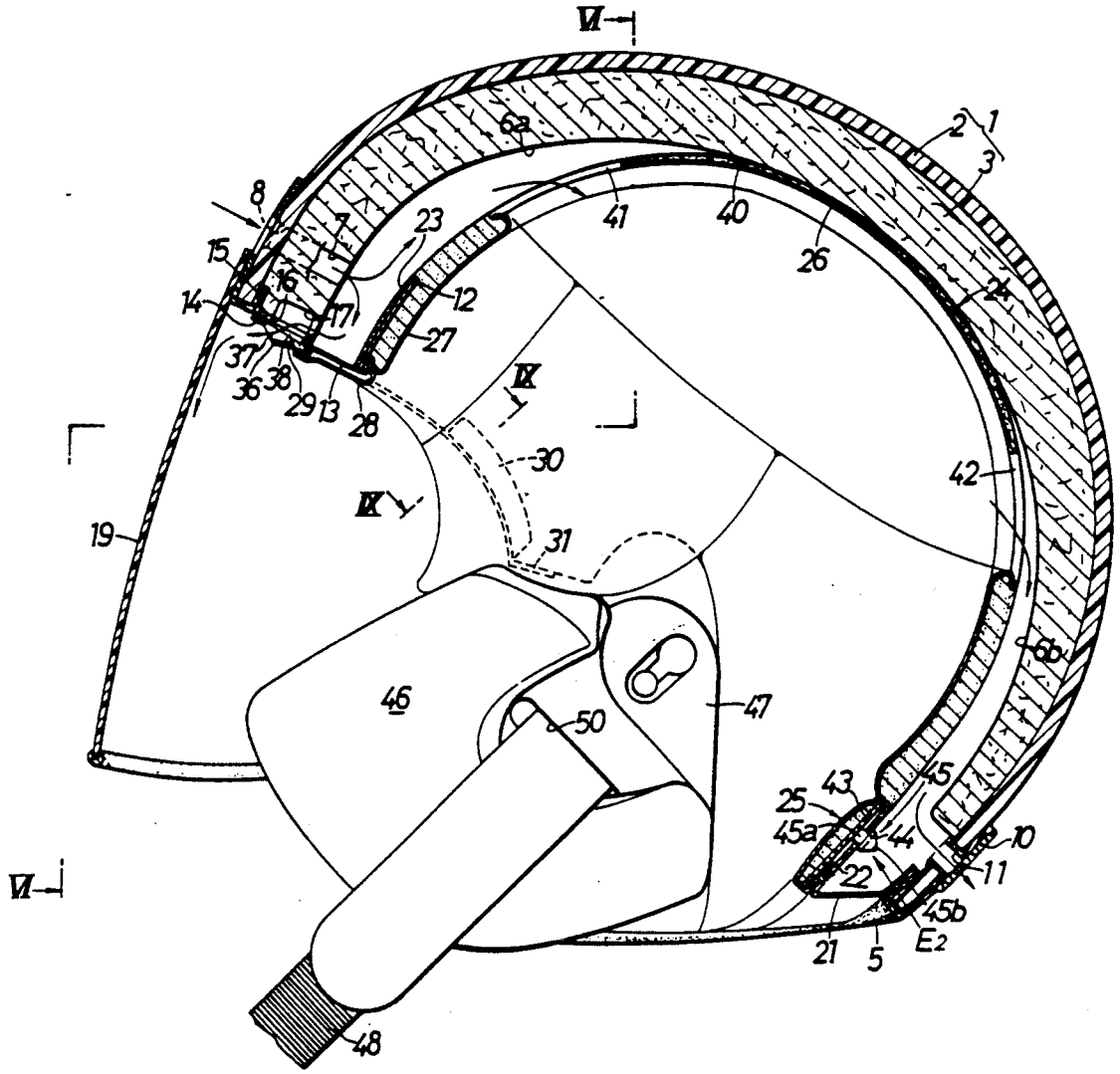
FIG. 4 is a sectional view taken along the line IV—IV in FIG. 3.
Figure 5:
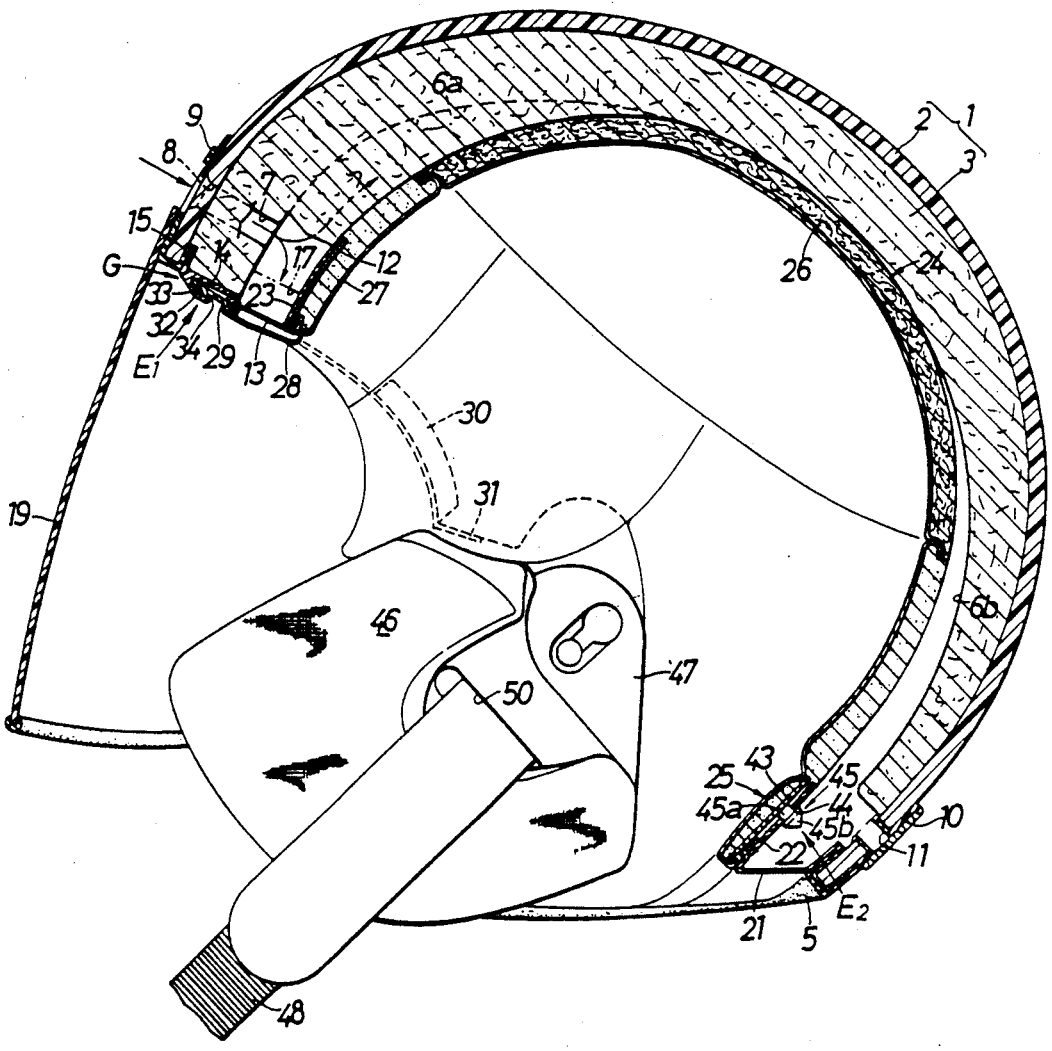
FIG. 5 is a sectional view taken along the line V—V in FIG. 3.
Figure 6:
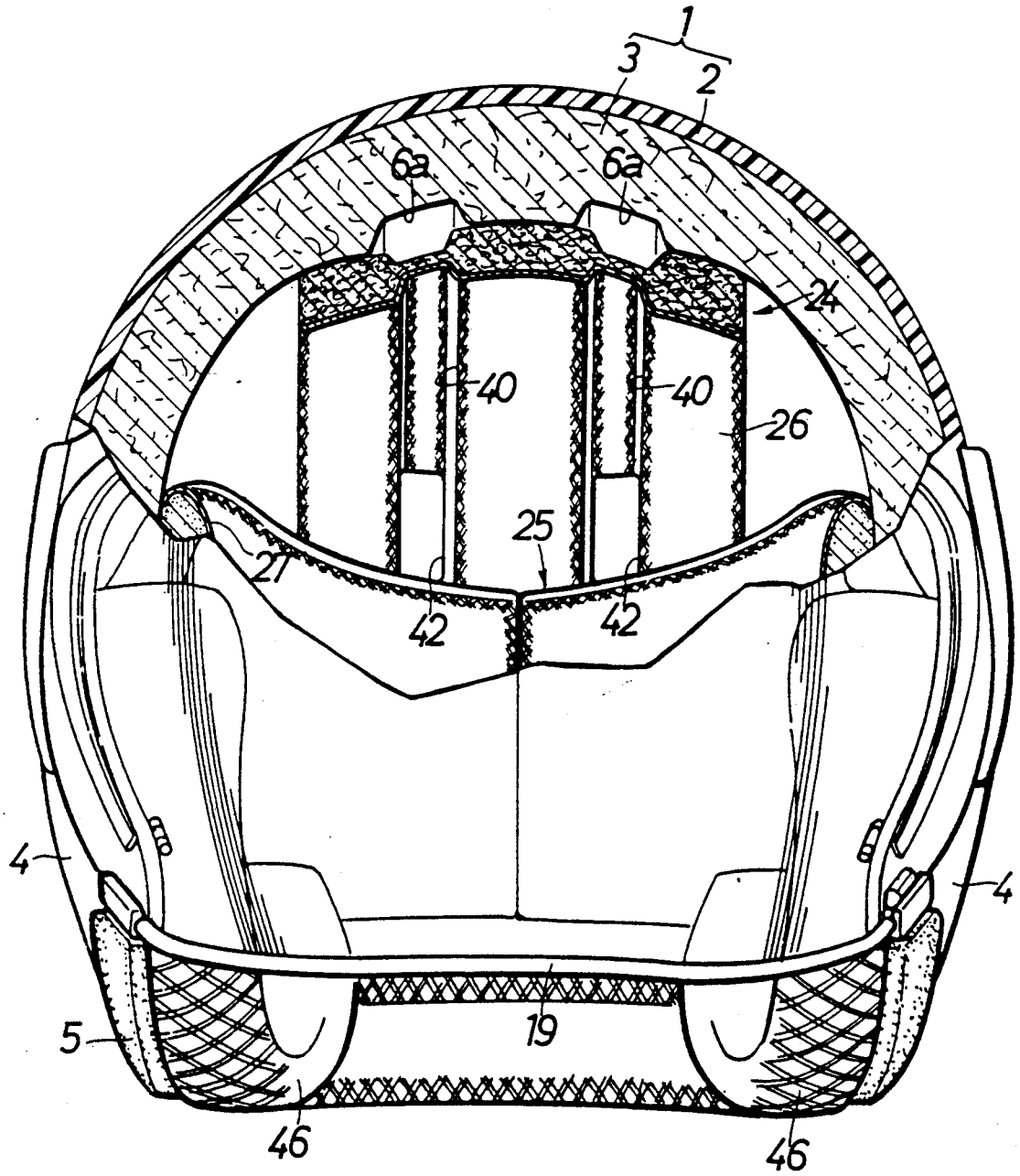
FIG. 6 is a sectional view taken along the line VI—VI in FIG. 4.

The present invention will now be described by way of embodiment with reference to the accompanying drawings.

Referring first to FIGS. 1 to 6, this helmet is a jet type helmet, a cap body 1 of the helmet comprises a shell 2 made of hard high strength resin as an outer shell and a buffer liner 3 made of foamed styrol which is closely fitted to an inner surface of the shell 2. A pair of left and right ear cover portions 4 are internally formed with the shell 2 and extend downward for covering the peripheries of ears of a wearer of the helmet. An edge member 5 made of rubber is adhesively fitted on a lower edge of the shell 2. The buffer liner 3 is adhesively fitted in the shell 2 excluding both the ear cover portions 4.

A shield plate 19, made of transparent synthetic resin for opening or closing a window 18, which is in a front of the cap body 1, is supported at its opposite ends on the cap body 1 on both sides of the window 18 through pivot sections 20. The shield plate 19 is turnable between a closing position indicated by a solid line in FIG. 1 and an opening position indicated by a dotted broken line in FIG. 1.

Two front ventilation grooves **6*a* extend longitudinally of the cap body 1. The grooves 6*a* are formed in a front inner surface of the buffer liner 3 near a lateral center line thereof. The rear ventilation grooves 6*b* extend longitudinally and correspond to the front ventilation grooves 6*a*. The grooves 6*b* are formed in the rear inner surface of the buffer liner 3. The ventilation grooves 6*a* and 6*b* are formed so as to become shallower in depth as approaching the top or summit of the inner surface of the buffer liner 3 so that the grooves 6*a* and 6*b* become flush with the inner surface of the buffer liner 3 at the top of the inner surface of the buffer liner 3. The front ends of the front ventilation grooves 6*a* communicate with a pair of vent holes 7 perforated in the buffer liner 3, respectively and the vent holes 7 communicate with a pair of air intake holes 8 formed in the front portion of the shell 2, respectively. A slide type opening/closing cover 9** is attached to the outer surface of the front portion of the shell 2 to open or close the air intake holes 8. A louver-like cover portion 10 has a plurality of lines of projections extending horizontally at vertical intervals therebetween. The cover portion 10 shape is integrally formed on the edge member 5 fitted on the lower edge of the shell 2 at a position corresponding to the lower end of the rear portion of the cap body 1 so as to cover the outer surface of the lower end of the rear portion of the shell 2. Two air discharge holes 11 communicating with the rear ventilation grooves 6*b* of the buffer liner 3 are formed in the cover portion 10. Accordingly, when a wearer of the helmet is travelling on a motorcycle, air streams are generated in the rear ventilation grooves 6*b* toward air discharge holes 11 by a negative air pressure generated in the air discharge holes 11.

Figure 7:
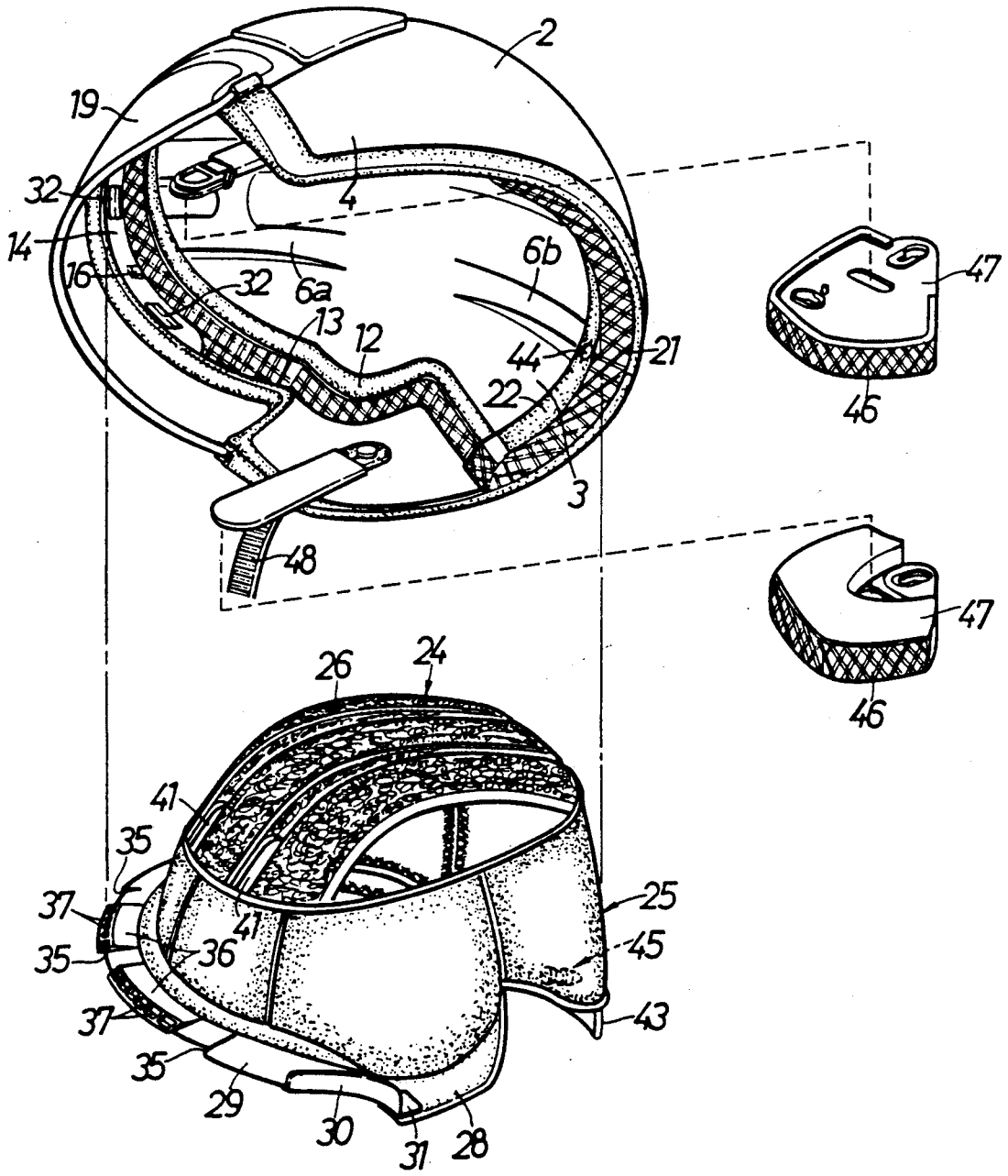
FIG. 7 is an exploded perspective view of a cap body and an inner pad.
Figure 8:
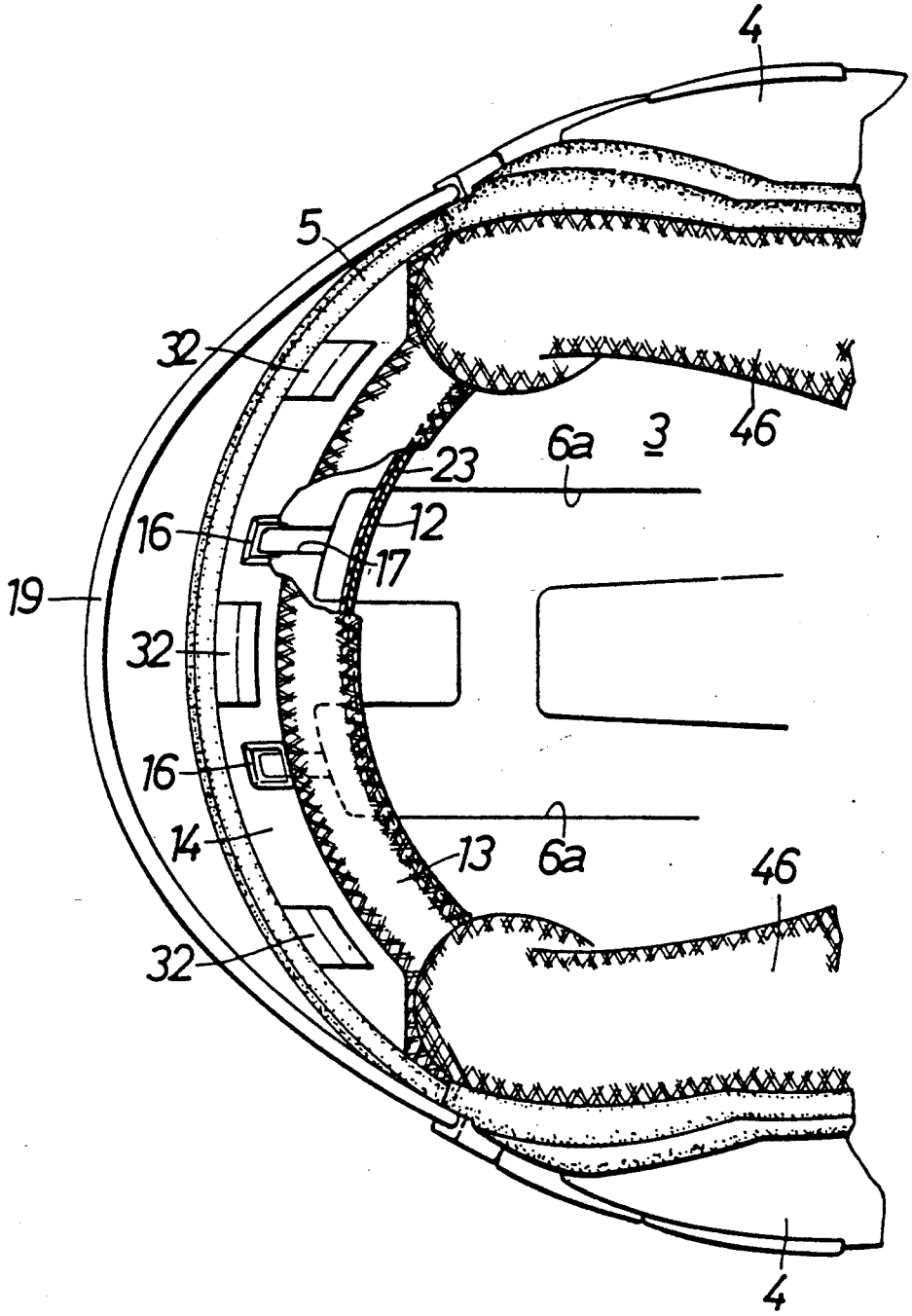
FIG. 8 is a bottom view of the front of the helmet with the inner pad being removed.
Figure 9:
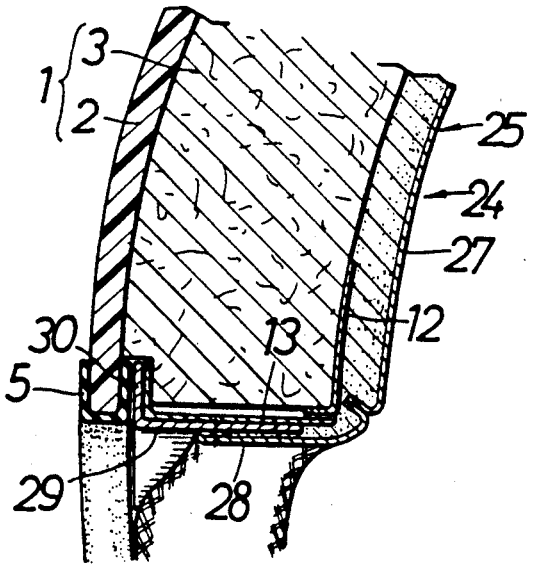
FIG. 9 is a sectional view taken along the line IX—IX in FIG. 4.

Referring also to FIGS. 7 to 9, a supporting sheet 12 made of flexible synthetic resin is adhered to the inner surface of the lower end of the buffer liner 3 excluding its rear portion. A cover plate 23 made of synthetic resin having a suitable rigidity is adhered to the supporting sheet 12 at portions corresponding to the front ends of both the front ventilation grooves 6*a*, thereby avoiding the entering of the supporting sheet 12 together with an inner pad 24, to be described later, into both the front ventilation grooves 6*a*. A supporting cloth 13 knitted at relatively big stitches to have air permeability is sewed to the supporting sheet 12, and a first supporting plate 14 covering the lower end face of the front portion of the buffer liner 3 is sewed to the supporting cloth 13. The first supporting plate 14 is formed of synthetic resin having relatively high rigidity, and formed in a circular arc shape corresponding to the lower end face of the front portion of the buffer liner 3 having a substantially L-shaped cross section so as to form an insertion portion 15 to be inserted between the buffer liner 3 and the shell 2. The peripheral edge of the supporting cloth 13 excluding the first supporting plate 14 is adhered to the outer surface of the buffer liner 3 to be held between the shell 2 and the liner 3 and hence, the supporting cloth 13 covers the end faces corresponding to the front and both side portions of the buffer liner 3. A pair of communication holes 16 are formed in the first supporting plate 14 to communicate with the front ends of the front ventilation grooves 6*a* via a communication groove 17 formed on the lower end face of the front portion of the buffer liner 3.

On the other hand, an end of a supporting cloth 21, for covering a lower end face of a rear portion of the buffer liner 3, is adhered to an outer surface of the buffer liner 3 at a lower end of the rear portion of the cap body 1 to be held between the shell 2 and the liner 3, and a second supporting plate 22 for covering an inner surface of the lower end of the rear portion of the buffer liner 3 is sewed to the supporting cloth 21. The supporting cloth 21 is knitted at relatively big stitches, and the second supporting plate 22 is formed of synthetic resin having relatively high rigidity.

An inner pad 24 is detachably disposed inside the buffer liner 3 in the cap body 1. The inner pad 24 comprises a side pad 25 fundamentally formed in a loop shape to be brought into contact with the side portion of the wearer's head, and a ceiling pad 26 formed integrally with the side pad 25 and brought into contact with a top portion of the wearer's head.

The entire surface of the side pad 25 is covered with a cloth cover 27 having air permeability. A cover extension portion 28 for covering the lower end face of the buffer liner 3 at the front portion and opposite sides of the cap body 1 is extended from the cover 27. A first mounting plate 29 to be detachably engaged with the first supporting plate 14 is sewed to the cover extension portion 28. This first mounting plate 29 is formed in a circular arc shape corresponding to the lower end face of the front portion of the buffer liner 3 and made of synthetic resin having relatively high rigidity, and is opposed to the first supporting plate 14. A pair of insertion portions 30 to be inserted between the buffer liner 3 and the shell 2 are formed at the front ends of the first mounting plate 29 closer to both peripheral ends thereof, and holding portions 31 to be held between ear pads 46, to be described later, and the buffer liner 3 are provided at opposite peripheral ends of the first mounting plate 29.

Guide means G for guiding a longitudinal sliding movement of the first mounting plate 29 between an engaging position and a separating position for defining a predetermined mounting position of the first mounting plate 29 with respective to the first supporting plate 14, and first locking means $E_1$ for detachably engaging the first mounting plate 29 with the first supporting plate 14 are provided at the first mounting plate 29 and the first supporting plate 14.

The guide means G has three engaging portions 32 provided at a peripheral interval on the first supporting plate 14, and three recesses 35 provided on the first mounting plate 29 corresponding to the engaging portions 32. Each of the engaging portions 32 is elongated from the front end of the first supporting plate 14 rearwardly by cutting and bending a portion of the first supporting plate 14 downwardly from its lower surface, and each of the recesses 35 is formed by notching the front end of the first mounting plate 29 to be followed by the corresponding engaging portion 32. The first mounting plate 29 can be guided at a predetermined mounting position between the insertion position and the separating position by engaging the engaging portions 32 in the recesses 35, respectively.

The locking means $E_1$ comprises pawls 34 respectively provided on upper surfaces of rear ends of the engaging portions 32, and locking projections 33 projected on lower surfaces of front ends of the recesses 35 to be engaged with the pawls 34.

The locking projections 33 of the first locking means $E_1$ are urged to engaged elastically with the corresponding pawls 34 by sliding the first mounting plate 29 from the rear separating position to the front engaging position on the first supporting plate 14 while defining the first mounting plate 29 in a predetermined mounting position by means of the guide means G. When the first mounting plate 29 is slid rearwardly from its locked state, the elastically engagement of the locking projections 33 with the pawls 34 are released, and the first mounting plate 29 is detached from the first supporting plate 14.

Box-shaped protrusions 36 are formed on the lower surface of the first mounting plate 29 between the recesses 35 protruding downward with its protruded plurality of diffusers or openings 37 open toward a forward direction of the helmet. The openings 37 are formed on the front ends of the protrusions 36, respectively. Passages 38 communicating with the communication holes 16 provided in the first supporting plate 14 are formed between the protrusions 36 and the first supporting plate 14 in a state where the first mounting plate 29 is engaged with the first supporting plate 14, and the diffusers 37 communicate with the front ends of the front ventilation grooves 6a through the passages 38, the communication holes 16 and the communication grooves 17.

The ceiling pad 26 is formed in a belt shape. The pad 26 has free ends at both left and right ends, and front and rear ends sewed to the front and rear ends of the side pad 25. An inner surface of the ceiling pad 26 is provided with a pair of ventilation grooves 40 corresponding to the pair of front ventilation grooves 6a and the pair of rear ventilation grooves 6b on the inner surface of the buffer liner 3, and also provided with a pair of guide holes 41 for communicating both the ventilation grooves 40 with the front ventilation grooves 6a, and a pair of guide holes 42 for communicating both the ventilation grooves 40 with the rear ventilation grooves 6b when the inner pad 24 is mounted in the cap body 1. If negative air pressure is generated in the air discharge holes 11 when the wearer of the helmet is travelling on a motorcycle, an air stream directed toward the rear ventilation grooves 6b through the front ventilation grooves 6a, both the guide holes 41, both the ventilation grooves 40 and both the guide holes 42 is generated.

A second mounting plate 43 opposed to the second supporting plate 22 is sewed to the rear end of the side pad 25 of the inner pad 24. The second mounting plate 43 is formed of synthetic resin having relatively high rigidity, and the second supporting plate 22 and the second mounting plate 43 are detachably engaged through second locking means $E_2$. The second locking means $E_2$ has a pair of engaging holes 44 provided at a peripheral interval in the second supporting plate 22, and a pair of engaging projections 45 projecting on the second mounting plate 43 to be elastically engaged with the respective engaging holes 44.

Each of both the engaging projections 45 is formed by a shaft 45a and an enlarged locking projection 45b which is connected to a tip end of the shaft 45a via a step and is formed tapered to have a gradually reduced free end. The maximum outer diameter of the enlarged locking portion 45b is larger than the inner diameter of the engaging hole 44. The engaging projections 45 are elastically engaged with the engaging holes 44 by pressing the enlarged locking portions 45b into the engaging holes 44.

Ear pads 46 for receiving wearer's ears are detachably mounted on an inner surfaces of the ear covers 4, respectively. The ear pads 46 are formed in a C-shaped to form recesses between the lower end of the buffer liner 3 and the pads 46 for receiving the wearer's ears, and are fixed to the inner surfaces of supporting plates 47 made of synthetic resin having relatively high rigidity, and the supporting plates 47 are detachably engaged with the ear covers 4, respectively.

A pair of chin straps 48 are to be coupled to one another for securing the cap body 1 to the head of the wearer of the helmet. The straps 48 are fixedly secured to the ear covers 4 through rivets 49. The chin straps 48 are inwardly extended through insertion holes 50 formed at the supporting plates 47 therein.

Description will now be made of the operation of this embodiment.

When mounting the inner pad 24 to the cap body 1, the first mounting plate 29 is urged forwardly in a state where the plate 29 is superposed on the first supporting plate 14 so that the recesses 35 are set at positions corresponding to the locking projections 33. Then, the first mounting plate 29 is guided from the separating position to the engaging position at a predetermined engaging position by means of the guide means G, the locking projections 33 are urged to enter between the engaging portions 32 and the first supporting plate 14, the locking projections 33 are elastically engaged with the pawls 34, and the first mounting plate 29 is engaged with the first supporting plate 14 by means of the first locking means $E_1$. The pair of insertion portions 30 are inserted between the buffer liner 3 and the shell 2 in the engaging state of the first locking means $E_1$ as described above, and the pair of holding portions 31 are inserted between the ear pads 46 and the buffer liner 3, thereby fixedly securing the front portion of the inner pad 24 to a predetermined position of the cap body 1. Then, the rear end of the inner pad 24 is engaged with the rear end of the cap body 1 by the second locking means $E_2$ thereby to complete mounting of the inner pad 24 to the cap body 1. Thus, the mounting operation is extremely easy.

In the mounting operation of the inner pad 24 to the cap body 1 as described above, the first mounting plate 29 is guided by the guide means G and is engaged with the first supporting plate 14 by means of the first locking means $E_1$ at the predetermined engaging position. Therefore, the mounting position of the inner pad 24 to the cap body 1 is easily determined.

When a user wearing a cap body 1 with the inner pad 24 mounted thereto is travelling on a motorcycle, if the air intake holes 8 of the front end of the cap body 1 are opened, a travelling wind is introduced from the air intake holes 8 into the front ventilation grooves 6a, a part of the introduced air is sucked out from the air discharge holes 11 through the guide holes 41, the ventilation grooves 40, the guide holes 42 and the rear ventilation grooves 6b to efficiently ventilate the interior of the cap body 1.

If the wearer of the helmet is in a stooped position with the wearer's head down in a state where the shield plate 9 is located at its closed position indicated by a solid line of FIG. 1 at the time in travelling on a motorcycle, a travelling wind is scarcely introduced into the shield plate 19. A part of the air introduced from the air intake holes 8 inside the cap body 1 is blown out forwardly from the plurality of diffusers 37 through the communication grooves 17, the communication holes 16 and the passages 38. Thus, when the shield plate 19 is set in its closed position, the air is blown out toward the inner surface of the shield plate 19. On the other hand, a downward air flow is generated inside the shield plate 19 when the wearer of the helmet is travelling on a motorcycle in a stooped position, and the air blown out from the diffusers 37 is downwardly directed along the inner surface of the shield plate 19. Therefore, the cloud on the shield plate 19 caused by the breath of the wearer of the helmet can be reliably prevented.

The present invention is applicable not only to the jet type helmet as in the above described embodiment, but also to a full-face type helmet. Further, the second locking means $E_2$ should not be limited only to a combination of the engaging hole 44 and the locking projection 45 as in the embodiment. Such a second locking means $E_2$ may be means using magic tapes or the like, for example.

What is claimed is:

1. A helmet comprising:

a cap body which is formed of a shell with a buffer liner fitted therein and said cap body includes an inner pad, covered with a cloth cover, disposed inside an inner surface of the buffer liner, wherein said cap body further includes a supporting plate fixed to said cap body for covering a lower end face of a front portion of said buffer liner and a mounting plate fixedly secured to said cover so as to oppose said supporting plate, said supporting plate and said mounting plate are provided with guide means for guiding a longitudinal sliding movement of said mounting plate between an engaging position and a separating position in order to define a predetermined mounting position of said mounting plate with respect to said supporting plate, and said supporting plate and said mounting plate are provided with first locking means for separating and engaging both said mounting plate and said supporting plate in response to the separating position and engaging position of said mounting plate, and a rear end of said inner pad is detachably connected to a rear end of said cap body through second locking means.

2. A helmet according to claim 1, wherein said guide means comprises a plurality of engaging portions formed by cutting and downwardly bending part of said supporting plate at circumferentially spaced positions, and a plurality of recesses formed at a front portion of said mounting plate to be fitted with said engaging portions, respectively.

3. A helmet according to claim 2, wherein said first locking means comprises a pawl provided at an upper surface of a rear end of each of said engaging portions, and a locking projection projecting at a lower surface of a front end of each of said recesses to be engaged with the pawl.

4. A helmet according to claim 1, wherein said shell is integrally and continuously formed with a pair of left and right ear cover portions for covering peripheries of a wearer's ears, said ear cover portions being provided at inner surfaces thereof with ear pads, and said mounting plate is provided at left and right ends thereof with holding portions to be held between the ear pads and the buffer liner.

5. A helmet according to claim 1, 2, 3 or 4, wherein said second locking means comprises an engaging hole formed at a second supporting plate secured to an inner face of a lower rear end portion of said buffer liner and an engaging projection for resiliently engaging with said engaging hole, said engaging projection being projected from a second mounting plate which is secured to the rear end of said inner pad so as to oppose said second supporting plate.

6. A helmet according to claim 5, wherein said engaging projection comprises a shaft and an enlarged locking portion provided at a free end of said shaft through a step, said enlarged locking portion is tapered so as to become smaller in diameter toward a tip end thereof, a maximum outer diameter of said enlarged locking portion being set larger than an inner diameter of said engaging hole.

7. A helmet according to claim 1, 2, 3 or 4, wherein said second locking means comprises a magic tape.

* * * * *